US011821720B2

(12) United States Patent
Isaacson et al.

(10) Patent No.: US 11,821,720 B2
(45) Date of Patent: Nov. 21, 2023

(54) ELASTIC MAGAZINE POUCH

(71) Applicant: AGILITE ERGONOMICS, LTD., Holon (IL)

(72) Inventors: Elie Isaacson, Givatayim (IL); Lev Israel Friedman, Ramat Gan (IL)

(73) Assignee: AGILITE ERGONOMICS, LTD.

( * ) Notice: Subject to any disclaimer, the term of this patent is extended or adjusted under 35 U.S.C. 154(b) by 0 days.

(21) Appl. No.: 17/703,026

(22) Filed: Mar. 24, 2022

(65) Prior Publication Data

US 2022/0325998 A1 Oct. 13, 2022

Related U.S. Application Data

(60) Provisional application No. 63/171,594, filed on Apr. 7, 2021.

(51) Int. Cl.
*F42B 39/02* (2006.01)

(52) U.S. Cl.
CPC ..... *F42B 39/02* (2013.01)

(58) Field of Classification Search
CPC ..... F42B 39/02; B65D 33/007; B65D 39/007; B65D 67/04; A45F 2200/0591; A45F 5/021
USPC ..... 383/33
See application file for complete search history.

(56) References Cited

U.S. PATENT DOCUMENTS

| | | | | |
|---|---|---|---|---|
| 1,672,382 | A * | 6/1928 | Harvey | B43K 25/024 24/3.12 |
| 7,407,139 | B1 * | 8/2008 | Dolan | B65B 67/1238 141/391 |
| 11,033,095 | B1 * | 6/2021 | VanHeusen | A45F 5/00 |
| 11,536,550 | B1 * | 12/2022 | Smith | F42B 39/02 |
| 2017/0099934 | A1 * | 4/2017 | Evans | A45F 5/021 |
| 2019/0014892 | A1 * | 1/2019 | Bryant | A45F 5/021 |

* cited by examiner

*Primary Examiner* — Corey N Skurdal
(74) *Attorney, Agent, or Firm* — BEHMKE INNOVATION GROUP LLC; Kenneth J. Heywood; James E. Denker

(57) ABSTRACT

A magazine accessory includes a magazine pouch including a body constructed of an elastic material, and a flared mouth element constructed of an elastomeric material which is stiffer than the elastic material of the body. The flared mouth element is coupled to the body to form a stay-open pouch entrance.

20 Claims, 2 Drawing Sheets

ELASTIC MAGAZINE POUCH

FIELD OF THE INVENTION

The present invention relates generally to firearm magazine pouches, and particularly to an elastic magazine pouch.

BACKGROUND OF THE INVENTION

Elastic magazine pouches have existed for some time. An example of a prior art elastic magazine pouch is shown in FIG. 1. The pouch 1 has an elastic opening 2 which elastically presses tightly on the magazine. Such a pouch retains the magazine very well and maintains a very low profile by "hugging" the magazine.

However, as major problem is that it is very difficult and cumbersome to re-insert the magazine after use. As this is a requirement that needs to be done fast in a firefight or during speed competition shooting, it is an issue and a real drawback of elastic pouches. Re-inserting is also a two-handed operation requiring the shooter to use one hand to stretch the pouch entrance and second hand to then insert the magazine. This is a problem because the shooter must take his/her hand off the firearm to do so.

SUMMARY OF THE INVENTION

The present invention seeks to provide a novel elastic magazine pouch which solves the above problems, as is described more in detail hereinbelow.

There is provided in accordance with a non-limiting embodiment of the present invention a magazine accessory including a magazine pouch including a body constructed of an elastic material, and a flared mouth element constructed of an elastomeric material which is stiffer than the elastic material of the body, the flared mouth element being coupled to the body to form a stay-open pouch entrance.

In accordance with a non-limiting embodiment of the present invention the stay-open pouch entrance is funnel-shaped.

In accordance with a non-limiting embodiment of the present invention the flared mouth element is sewn or applied to the elastic material of the body while the elastic material of the body is stretched.

In accordance with a non-limiting embodiment of the present invention the flared mouth element is constructed of a plastic.

In accordance with a non-limiting embodiment of the present invention the flared mouth element includes a front portion and two side portions which extend from opposite sides of the front portion at bendable portions. The side portions may be separated from the front portion by gaps.

In accordance with a non-limiting embodiment of the present invention the pouch is assembled on a placard. The placard may be formed with slots on either side of the pouch.

In accordance with a non-limiting embodiment of the present invention the flared mouth element includes an auxiliary attachment slot.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
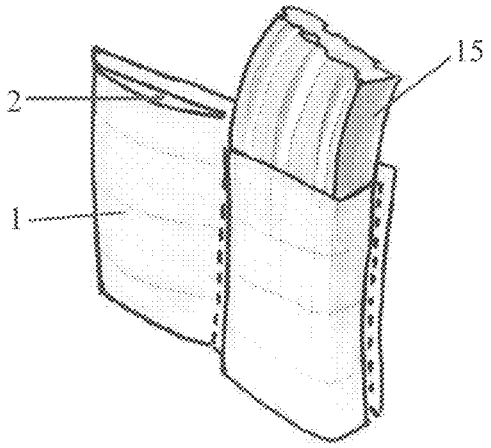
FIG. 1 PRIOR ART
FIG. 1 is a simplified perspective illustration of a prior art magazine pouch.
Figure 2:
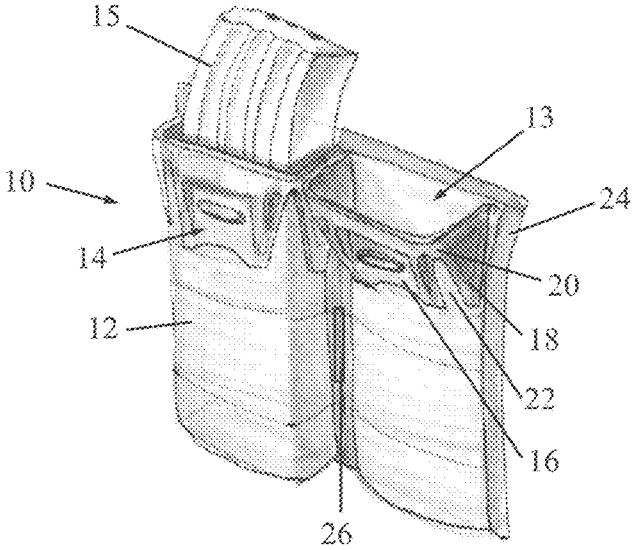
FIG. 2 is a simplified perspective illustration of a magazine pouch, constructed and operative in accordance with a non-limiting embodiment of the present invention.

Reference is now made to FIG. 2, which illustrates an elastic magazine pouch 10, constructed and operative in accordance with an embodiment of the present invention.

The pouch 10 has a body 12 which may be constructed of any suitable elastic material used in the body of elastic magazine pouches, such as but not limited to, elastic nylon weaves, elastic fabrics and many others.

The pouch 10 is not limited to a single-pouch configuration, and the invention can be carried out in many configurations, such as but not limited to, double, double stack, triple, etc.

In contrast to the prior art, pouch 10 includes a flared mouth element 14, which may be constructed of any elastomeric material which is stiffer than the material of body 12, such as but not limited to, a plastic, e.g., thermoplastic polyurethane (TPU) or polyvinyl chloride (PVC) or other suitable polymer, or natural or synthetic rubber, e.g., EPDM (ethylene propylene diene monomer) or neoprene, or other materials, depending on the application.

The flared mouth element 14 may be sewn or applied to the elastic material of the body 12 while the elastic material of the body 12 is stretched. This allows the elastic material at the top entrance opening 13 of the pouch 10 to retain its shape permanently, while at the same time, the lower part of the pouch (body 12) retains a low profile. Even the stay-open, flared mouth element 14 can be squashed flat if necessary.

The elastic material retains the magazine 15 at a very high level (it "hugs" the magazine), yet re-insertion of the magazine 15 is a completely one-handed operation and can be done faster, less accurately aligned and more-easily due to the funnel created by the flared mouth element 14.

Figure 3:
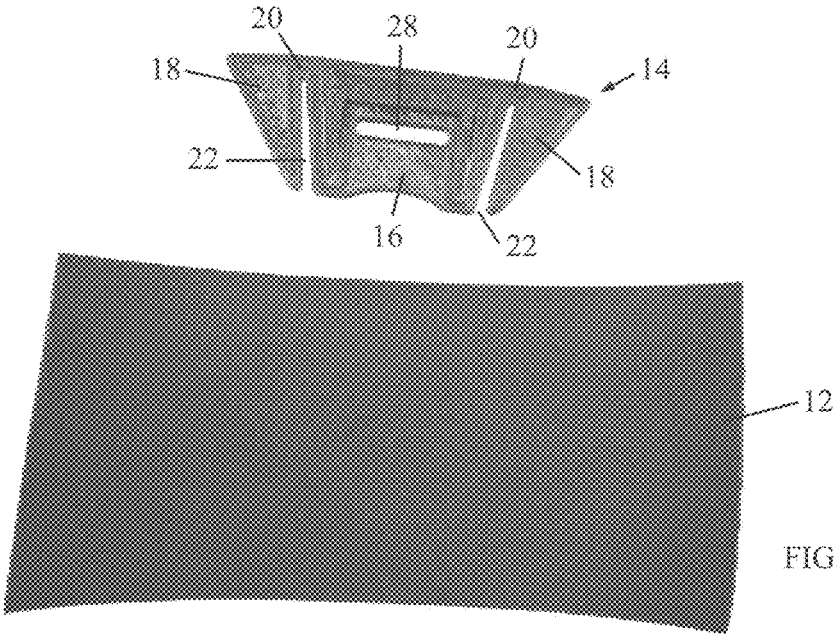
FIG. 3 is a simplified pictorial illustration of the flared mouth element of the magazine pouch and the elastic material of the body of the magazine pouch.

As seen in FIG. 3, flared mouth element 14 may include a front portion 16 and two side portions 18 which extend from opposite sides of the front portion 16 at bendable portions 20. The lower portions of side portions 18 are separated from front portion 16 by gaps 22.

As seen in FIG. 2, pouch 10 or pouches 10 may be assembled on a placard 24. The placard 24 may be formed with slots 26 on either side of each pouch 10 for inserting therethrough straps for attaching auxiliary pouches or other equipment.

The pouch 10 thus has a stay-open pouch entrance 13 created by flared mouth element 14. Even when pouch 10 is empty, there is a funnel-shaped or flared stay-open entrance 13 which enables one-handed insertion, extraction and re-insertion (re-indexing) of the magazine, with no need for the user to stretch the pouch open. Although permanently open, the flared mouth element 14 is semi rigid and can be squashed down easily.

The flared opening guides the magazine into the pouch smoothly, correcting any insertion angle to the correct insertion angle for the pouch.

The flared mouth element 14 may include an auxiliary attachment slot 28 that allows for additional pouches and items to be attached through it, adding a second storage layer to the outside of the funnel pouch 10.

The flared mouth element 14 protects the pouch opening 13 from fraying, tearing and general wear from constant fast, aggressive insertion of metal, heavy magazines. This is in contrast to prior art elastic magazine pouches which are not very durable in a military environment.

Figure 4A:
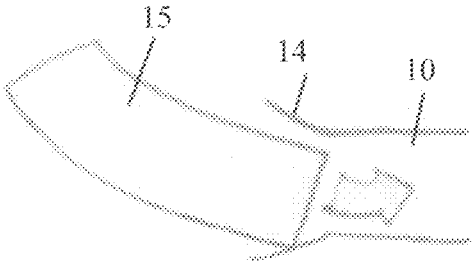
FIGS. 4A and 4B are simplified pictorial illustrations of inserting a magazine into the flared mouth element of the magazine pouch.
Figure 4B:
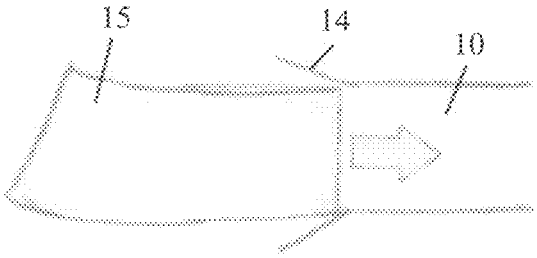

FIGS. 4A and 4B show how the flared mouth element 14 of the magazine pouch guides the magazine 15 into the pouch 10.

What is claimed is:

1. A magazine accessory comprising:

a magazine pouch defined by a flexible wall formed of an elastic material; and a flared mouth element constructed of an elastomeric material which is stiffer than the elastic material, the flared mouth element being coupled to to the flexible wall and being configured to form a stay-open entrance into the magazine pouch, wherein the flared mouth element includes a top opening and a bottom outlet and wherein a size of the bottom outlet is adjustable independent from a size of the top opening.

2. The magazine accessory according to claim 1, wherein the stay-open entrance is funnel-shaped.

3. The magazine accessory according to claim 1, wherein the flared mouth element is coupled to the flexible wall in a manner that causes elastic force of the flexible wall to bias a lower end of the flared mouth element into a funnel shape when the magazine pouch is empty.

4. The magazine accessory according to claim 1, wherein the flared mouth element is constructed of a plastic.

5. The magazine accessory according to claim 1, wherein the flared mouth element comprises a front portion and two side portions which extend from opposite sides of the front portion at bendable portions.

6. The magazine accessory according to claim 5, wherein lower portions of the two side portions are separated from a lower portion of the front portion by gaps.

7. The magazine accessory according to claim 1, wherein the flexible wall of the magazine pouch is coupled to a placard.

8. The magazine accessory according to claim 7, wherein the placard is formed with slots on either side of the magazine pouch.

9. The magazine accessory according to claim 1, wherein the flared mouth element comprises an auxiliary attachment slot.

10. The magazine accessory according to claim 1, wherein the flexible wall is attached to a backing substrate and defines an interior space of the magazine pouch located between the flexible wall and the backing substrate.

11. The magazine accessory according to claim 1, wherein an upper portion of the flared mouth element is configured to resiliently maintain the size of the top opening.

12. The magazine accessory according to claim 1, wherein the bottom outlet leads into an interior space of the magazine pouch.

13. The magazine accessory according to claim 1, comprising a lower portion of the flared mouth element configured to be flexed, independently of an upper portion of the flared mouth element, toward a backing substrate by elastic force of the flexible wall.

14. The magazine accessory according to claim 1, wherein the flared mouth element is constructed of a resiliently deformable material configured to elastically return to a funnel geometry upon removal of a deforming force.

15. The magazine accessory according to claim 1, wherein the flared mouth element comprises a front portion defining a front wall of the stay-open entrance and two side portions defining opposing sidewalls of the stay-open entrance.

16. The magazine accessory according to claim 15, wherein the front wall of the stay-open entrance is configured to have an adjustable slope.

17. The magazine accessory according to claim 15, wherein the front wall of the stay-open entrance has a trapezoidal geometry.

18. The magazine accessory according to claim 15, wherein the opposing sidewalls of the stay-open entrance each have a triangular geometry.

19. The magazine accessory according to claim 1, wherein the flexible wall is configured to contact a magazine inserted in the magazine pouch.

20. The magazine accessory according to claim 1, wherein a first portion of the flared mouth element is configured to retain its spatial relationship to a backing substrate during object insertion and a second portion of the flared mouth element is configured to modify its spatial relationship to the backing substrate during the object insertion to conform to dimensions of an object being inserted.

* * * * *